US006217489B1

(12) United States Patent
Nicholson

(10) Patent No.: US 6,217,489 B1
(45) Date of Patent: Apr. 17, 2001

(54) HEAVY BAG AND METHOD FOR FILLING

(75) Inventor: Robert Steven Nicholson, Knoxville, TN (US)

(73) Assignee: Bollinger Industries, L.P., Grand Prairie, TX (US)

( * ) Notice: Subject to any disclaimer, the term of this patent is extended or adjusted under 35 U.S.C. 154(b) by 0 days.

(21) Appl. No.: 08/918,721

(22) Filed: Aug. 22, 1997

(51) Int. Cl.[7] ..... A63B 21/00
(52) U.S. Cl. ..... 482/83; 482/87; 482/90
(58) Field of Search ..... 482/83–90; 473/441, 473/445

(56) References Cited

U.S. PATENT DOCUMENTS 4,527,796 * 7/1985 Critelli ..... 482/8
4,648,851 * 3/1987 Rosenberg ..... 446/372
4,667,954 * 5/1987 McCorkle ..... 482/87
4,721,302 * 1/1988 Murphy ..... 482/87
5,191,168 * 3/1993 Pucket ..... 102/457
5,280,905 * 1/1994 Micco ..... 482/85
5,324,042 * 6/1994 Demas ..... 273/346
5,492,320 * 2/1996 Hoffman et al. ..... 273/415

* cited by examiner

*Primary Examiner*—Jerome W. Donnelly
(74) *Attorney, Agent, or Firm*—James E. Bradley; Shawn Hunter; Felsman, Bradley, Vaden, Gunter & Dillon L.L.P.

(57) ABSTRACT

The invention described in the specification relates to a heavy bag for use in training a boxer and to a method for filling the bag. The bag has a substantially cylindrical outer shell made from a fabric-like material, the shell having closed ends. A shredded rubber material fills the bag and provides the bag with sufficient weight for punching and sparring training activities. Use of the shredded rubber material to fill the bag not only permits significant improvement in the bag filling operation but also provides increased durability, improved impact absorbing characteristics and less permanent deformation of the bag during use.

23 Claims, 2 Drawing Sheets

HEAVY BAG AND METHOD FOR FILLING

The invention relates to a heavy boxing bag apparatus and to an improved method for filling heavy boxing bags.

BACKGROUND

Conventional heavy bags used for training for boxing and sparring are typically filled with shredded fabric or paper, polyester batting, jute, sawdust or other light weight shredded materials and have sand bags interspersed in the fill material to provide the desired bag weight so that when the boxer punches the bag, the feel experienced by the boxer resembles that of punching another boxer. Such bags are typically filled by hand with careful placement of the sand bags to distribute the weight evenly within the bag and to prevent misshapened bags or bags which do not provide the proper impact-absorbing function upon being struck or punched.

Heavy bags may weigh from 25 to 100 pounds or more depending on the size and use of the bag. Smaller bags require less weight and thus fewer sand bags while larger bags typically require more weight and thus more sand bags. Because not all bags are manufactured to the have the same weight, production of a variety of bag sizes and bags having different weights is a time consuming, often manpower intensive operation which does not readily lend itself to automation.

Another disadvantage of conventional heavy bags is that they often lose there shape over time as a result of repeatedly punching the same area of the bag. Punching the bag causes movement of the shredded fabric or paper, polyester batting, jute, sawdust and/or sand bags within the bag. Reshaping of a misshapen bag requires the bag be opened and the fill material and sand bags be redistributed or repacked within the bag. Unless the fill material is redistributed periodically, damage to the bag may occur from repeated punching of the bag after the material has shifted.

An object of the invention is to provide an improved heavy bag for boxing and sparring training.

Another object of the invention is to provide a heavy bag which will maintain its shape substantially longer than conventional heavy bags.

A further object of the invention is to provide a method for filling a heavy bag used for boxing and sparring training activities.

Still another object of the invention is to provide a heavy bag having a weighting material therein which is may be used to fill a variety of heavy bags with a minimum of manpower.

Yet another object of the invention is to provide a heavy bag that has a feel which more closely resembles the feel of punching a human being.

Another object of the invention is to improve the performance and durability of a heavy bag.

A still further object of the invention is to provide a heavy bag of the character described which economical to manufacture.

SUMMARY OF THE INVENTION

With regard to the above and other objects, the invention provides a heavy bag for boxing and sparring training including a natural or synthetic fabric web having a substantially cylindrical shape and having opposed closed ends which defines a closed chamber containing pellets or granules of rubber which substantially fill the chamber.

In another aspect the invention provides a method for filling a heavy bag used for boxing or sparring training activities. The method includes forming a chamber having substantially cylindrical walls made from a resilient web-like material wherein the chamber has a closed end and an open end, loading the chamber through the open end with a rubber material in granular or pellet form and closing the open end to provide a substantially filled heavy bag.

An advantage of the heavy bag loaded with a rubber material as described herein is that the bag maintains its shape substantially longer and provides a more realistic feel when punched or struck as compared to conventional bags filled with shredded fabric, sawdust or jute and weighted with sand bags. Furthermore, the rubber material is easier to handle and loading a bag with such material may be conducted more quickly and with substantially less manpower than filling and packing a conventional heavy bag.

BRIEF DESCRIPTION OF THE DRAWINGS

Other benefits and advantages of the invention will be evident from the drawings in conjunction with the following description in which.

DETAILED DESCRIPTION OF THE PREFERRED EMBODIMENTS

Figure 1:
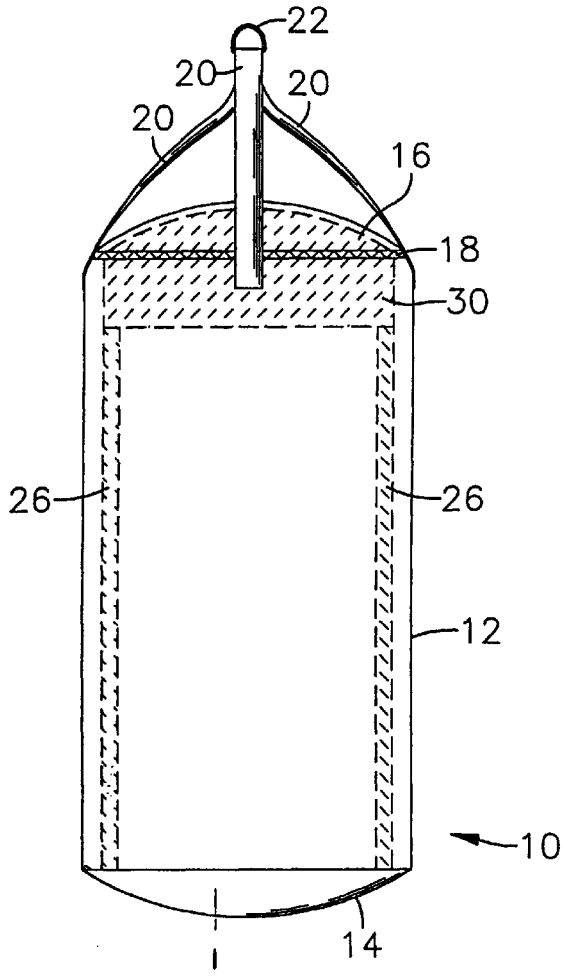
FIG. 1 is an elevational view of a heavy bag according to the invention.

With reference to FIG. 1, there is provided a heavy bag 10 for use in boxing and sparring training activities. The bag 10 includes a substantially cylindrical fabric shell, sleeve or outer layer 12 preferably provided by a natural or synthetic web-like or fabric material such as canvas, nylon, polyester, leather and the like having a closed end 14 opposite a closeable end 16 defining a chamber therein. The closed and closeable ends may be made out of the same or different material as the shell 12. End 16 may be closed after filling the bag as by closure device 18 such as a zipper, hook and loop fastener, snaps, buttons or by sewing a portion of end 16 to an adjacent portion of shell 12. Closed end 14 may be permanently or temporarily attached to the shell 12 by use of devices similar to the devices used to close closeable end 16.

Heavy bags are typically suspended from a hook or other support device so that they hang freely. Thus, suspension straps 20 and support ring 22 may be provided for use in suspending the bag from a support such as a ceiling or cantilevered frame. Additional straps may be attached adjacent closed end 14 of the bag if desired to prevent the bag from swinging too far or to reduce the tendency of the bag to swing when struck or punched. It will also be recognized that the bag may be also suspended horizontally by attaching the suspension straps 20 to ends 14 and 18 of the bag 10 or to a central portion of the cylindrical surface of the bag. The orientation of the bag in use is not important to the invention.

A unique feature of the heavy bag according to the invention is the use of a resilient, substantially free-flowing granular or pellet material as a impact absorbing material which substantially fills the bag 10. The granular or pellet material is preferably a shredded rubber material having a density ranging from about 20 to about 35 pounds per cubic foot and having an average size of from about 1 to about 10 mm in the longest dimension. A preferred source of shredded rubber material is shredded tires, however, any shredded rubber material and preferably those having the size and density described above may be used to load the bag. Recycled, shredded rubber material which may be used to fill the bag is available from rubber recycling sources such as NRI of Easton, Md.

Figure 2:
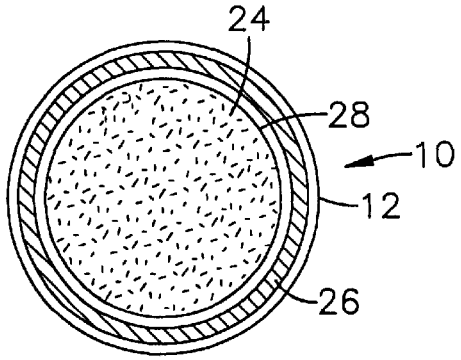
FIG. 2 is a cross-sectional view not to scale of a heavy bag showing a preferred construction thereof.

FIG. 2 provides a cross-sectional view of a heavy bag 10 according to the invention showing the shredded rubber material 24 within the bag. The outer shell 12 is preferably provided by a web-like material having a substantially cylindrical shape. In order to soften the impact exerted by a boxer on the bag, it is preferred to line substantially all of the inner surface of the shell 12 with a foam pad 26. The foam pad 26 may be an open cell polyurethane foam, a closed cell polyethylene foam or any other padding or cushing material conventionally used to provide a resilient impact surface which is softer than the material used to fill the bag.

A preferred foam pad 26 has a thickness ranging from about 0.25 to about 4 inches or more depending on the diameter of the bag. For heavy bags having weights ranging from 25 to about 100 pounds, a pad having a thickness ranging from about 0.5 to about 1.5 inches is preferable.

Between the foam pad 26 and the fill material 24 there is preferably placed a barrier 28. The barrier 28 is preferably composed of a substantially air impermeable material such as heavy weight paper or paperboard. The weight of paper or paperboard used for barrier 28 is not critical to the invention but will typically have a caliper ranging from about 10 to about 40 thousands of an inch (about 10 to about 40 point board) available from Accurate Paper Box Company, Inc. of Knoxville, Tenn. Other air impermeable materials may be used for the barrier 28 such as plastic films, molded plastic sheets, and the like. It is preferred that the barrier 28 be sufficiently rigid so as to be substantially self-supporting in order to maintain the pad 26 and shell 12 in a substantially upright position while the bag is being loaded with shredded rubber 24.

Once the bag has been loaded, a packing stuffer pad 30 is used to maintain the shredded rubber in a closely packed configuration so that the bag substantially maintains its shape. The stuffer pad 30 may be made of a variety of materials which may be compressed but which resiliently returns to its shape when the compression force is removed. A suitable stuffer pad 30 is an open cell polyurethane foam. Other materials which may be used to provide the stuffer pad 30 include closed cell foams such as polyethylene foam or any other resiliently compressible material.

A preferred stuffer pad 30 has a thickness of about 4 inches, however thicknesses of from about 2 to about 6 inches or more may be used to compress the fill material in order to maintain the fill material in its closely packed orientation. The weight of the bag may be adjusted by using more or less fill material 24, higher or lower density fill material and a thicker or thinner stuffer pad 30 for a selected heavy bag size.

A distinct advantage obtained by using shredded rubber fill material 24 of the size and density described above to load and weight a heavy bag 10 is that shredded rubber provides an impact absorbing effect and a sufficient weight to the bag and yields a bag having improved punching characteristics as compared to conventional heavy bags. Accordingly, there is no need to add additional weight to the bag with sand bags or similar ballast or weighting materials. Furthermore, because the shredded rubber as described herein is substantially free-flowing, there is less tendency for the bag to be misshapened or damaged over time. If the bag becomes misshapen on one side due to punching or striking the same spot, striking the opposite side of the bag will cause movement of the shredded rubber within the bag so that the bag is reshaped by use rather than by opening the bag and redistributing the packing material by hand. The sleeve or fabric shell 12 and packing stuffer 30 also maintain the shredded rubber in a closely packed configuration so that the bag simulates a human body when punched or struck.

Figure 3:
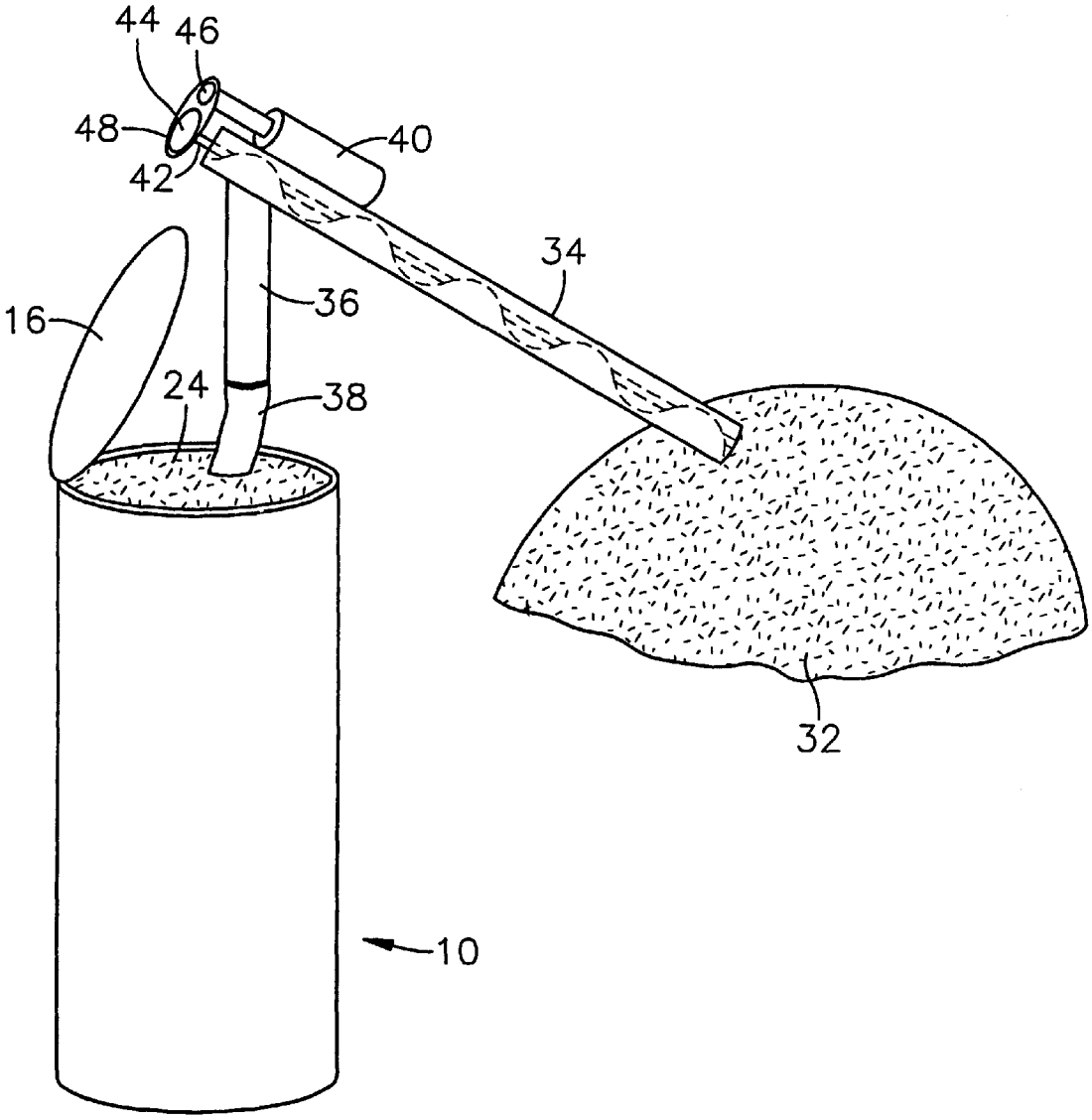
FIG. 3 is a simplified illustration of a preferred method for filling a heavy bag according to the invention.

Referring now to FIG. 3, there is illustrated a preferred method for loading heavy bags 10 according to the invention. In the method, a source of shredded rubber 32 is provided. The shredded rubber is transferred to the heavy bag by means of a transfer device 34. The transfer device 34 may be a conventional grain auger or a pneumatic conveyor or any other granular or pellet material transfer device known by those of ordinary skill to be useful for transferring such free-flowing materials from one location to another. In the alternative, the bag may be filled by gravity from an overhead source of shredded rubber fill material. The shredded rubber is preferably sufficiently free-flowing so as to promote the loading of heavy bags with a minimum of effort.

Use of a loading device 34 such as a grain auger or pneumatic transfer unit enables a heavy bag 10 to be loaded with the shredded rubber 24 in a matter of a few seconds as opposed to hand packing a heavy bag with shredded cloth, etc. and sand bags which may take a substantially longer amount of time. Accordingly, the use of shredded rubber fill material as a weighting and fill material for a heavy bag significantly decreases the time and manpower previously required to load a heavy bag with conventional materials.

During the loading operation, end 16 of the bag 10 is opened and a nozzle 36 having a flexible spout 38 is positioned over the bag 10 so that shredded rubber material 24 will be directed into the bag to substantially fill the bag. Once the nozzle 36, spout 38 and bag 10 are properly positioned, the loading operation can begin. In the case where a grain auger is used as the loading device 34, the motor 40 of the auger is turned on to fill the auger 34, nozzle 36 and spout 38 with shredded rubber material from source 32. The motor is connected either directly to the auger shaft 42 or indirectly by means of pulleys 44 and 46 and belt 48.

When a sufficient amount of shredded rubber material has been transferred into the bag 10, the motor 40 of the auger is turned off and the bag is closed by attaching end 16 to shell 12 using a zipper or other closure device. Prior to closing the bag, a foam pad 30 (FIG. 1) as described above is inserted over the fill material 24. The foam pad 30 is preferably slightly compressed over the fill material 24 by end 16 so that the pad 30 maintains the fill material in a closely packed orientation in order to provide a heavy bag 10 having a suitable impact absorbing effect.

Having described and illustrated various aspects and embodiments of the invention, it will be appreciated that many modifications, rearrangements, additions, improvements and substitutions may be made to these embodiments by those of ordinary skill all of which are nevertheless within the spirit and scope of the invention as defined in the appended claims.

What is claimed is:

1. A heavy bag for boxing and sparring training comprising a natural or synthetic fabric web having a substantially cylindrical shape and having opposed closed ends thereby defining a closed chamber containing pellets or granules of rubber substantially filling the chamber, and a suspension strap affixed to the web to suspend the bag from a ceiling, frame or the like during punching of the bag.

2. The heavy bag of claim 1 further comprising a foam pad lining the cylindrically shaped web.

3. The heavy bag of claim 2 wherein the foam pad has a thickness ranging from about 0.25 to about 4 inches.

4. The heavy bag of claim 3 wherein the foam pad comprises open cell polyurethane foam.

5. The heavy bag of claim 1 wherein the rubber has a density ranging from about 20 to about 35 pounds per cubic foot.

6. The heavy bag of claim 5 wherein the rubber has an average size of from about 1 to about 10 mm in its longest dimension.

7. The heavy bag of claim 2 further comprising a substantially impermeable air barrier between the shredded rubber fill material and foam pad.

8. The heavy bag of claim 7 wherein the barrier comprises a paper or paperboard web.

9. A training bag device which comprises a fabric-like substantially cylindrical shell having closed ends and having an interior surface of the shell lined with a foam pad thereby defining a lined chamber, a weighting material substantially filling the chamber and a substantially vapor impermeable liner between the foam pad and the weighting material, wherein the weighting material comprises rubber granules or pellets having a density ranging from about 20 to about 35 pounds per cubic foot.

10. The training bag of claim 9 wherein the foam pad has a thickness ranging from about 0.25 to about 4 inches.

11. The training bag of claim 9 wherein the foam pad comprises open cell polyurethane foam.

12. The training bag of claim 9 wherein the liner comprises a paper or paperboard web.

13. The training bag of claim 9 wherein the rubber granules or pellets have an average size of from about 1 to about 10 mm in its longest dimension.

14. A bag for boxing training comprising a substantially closed sleeve and a plurality of rubber pellets or granules contained within the sleeve having a density ranging from about 20 to about 35 pounds per cubic foot and an average size of from about 1 to about 10 mm along their longest dimension, the rubber pellets or granules being maintained within the sleeve in a substantially closely packed configuration so as to provide an impact absorbing effect which simulates a human body.

15. The bag of claim 14 further comprising a foam pad adjacent an inside surface of the sleeve separating the sleeve from the rubber granules or pellets.

16. The bag of claim 15 wherein the foam pad comprises an open cell polyurethane foam having a thickness ranging from about 0.25 to about 4 inches.

17. The bag of claim 16 further comprising a substantially air impermeable paper or paperboard web disposed between the rubber pellets or granules and the foam pad.

18. A punching bag for training of boxers and the like comprising:

an outer shell that defines an interior chamber and providing an outer surface for receiving punches, the outer shell comprising a substantially cylindrical shape with a closed bottom end and a closeable top end that may be opened for placement of filler in to the interior chamber; and a resilient filler within the interior chamber of the outer shell, the filler comprising granular or pellet material formed of rubber, the filler being substantially closely packed to simulate a human body when the bag is punched.

19. The punching bag of claim 18 further comprising a compressible packing stuffer pad disposed within the interior chamber to assist in maintaining the filler in a packed configuration.

20. The punching bag of claim 19 wherein the stuffer pad is disposed above the filler.

21. The punching bag of claim 18 where in the outer shell is formed of a fabric web.

22. A punching bag for training of boxers and the like comprising:

an outer shell that defines an interior chamber;

a resilient filler within the interior chamber of the outer shell;

a compressible packing stuffer pad disposed within the interior shell above the filler, the stuffer pad being formed of a material that is softer than the filler.

23. The punching bag of claim 22 wherein the stuffer pad is formed of polyurethane foam.

* * * * *